US008638210B2

(12) United States Patent
Simon et al.

(10) Patent No.: US 8,638,210 B2
(45) Date of Patent: Jan. 28, 2014

(54) WIRELESS TAKEOVER OF WIRED ALARM SYSTEM COMPONENTS

(75) Inventors: Scott Harris Simon, Melville, NY (US); Lance Leo Dean, Colleyville, TX (US)

(73) Assignee: 2GIG Technologies, Inc., Lehi, UT (US)

( * ) Notice: Subject to any disclaimer, the term of this patent is extended or adjusted under 35 U.S.C. 154(b) by 580 days.

(21) Appl. No.: 12/480,369

(22) Filed: Jun. 8, 2009

(65) Prior Publication Data

US 2010/0308990 A1 Dec. 9, 2010

(51) Int. Cl.
*G08B 29/00* (2006.01)
*G08B 1/08* (2006.01)

(52) U.S. Cl.
USPC . 340/506; 340/521; 340/539.14; 340/539.16; 340/539.17; 340/531; 340/693.2

(58) Field of Classification Search
USPC ..... 340/506, 539.14, 539, 16, 539.17, 531
See application file for complete search history.

(56) References Cited

U.S. PATENT DOCUMENTS

| | | | | |
|---|---|---|---|---|
| 4,951,029 | A | 8/1990 | Severson | |
| 5,134,644 | A * | 7/1992 | Garton et al. | 379/39 |
| 5,748,083 | A | 5/1998 | Rietkerk | |
| 6,380,580 | B1 | 4/2002 | Arita | |
| 6,759,956 | B2 * | 7/2004 | Menard et al. | 340/539.19 |
| 2005/0242944 | A1 * | 11/2005 | Bankert et al. | 340/531 |

* cited by examiner

*Primary Examiner* — Donnie Crosland
(74) *Attorney, Agent, or Firm* — Schwegman, Lundberg & Woessner, P.A.

(57) ABSTRACT

The present invention extends to methods, systems, and computer program products for wireless takeover of wired alarm system components. Embodiments of the invention can be used to bridge hardwired alarm zones for use with a wireless alarm controller. Wired sensors are wired to a takeover module that converts communication from the wired sensors into wireless communication that can be compatibly processed at an alarm controller that accepts wireless signals. Power and ground connections from an existing wired alarm controller can be used with the takeover module to facilitate wireless takeover of wired alarm sensors.

24 Claims, 5 Drawing Sheets

WIRELESS TAKEOVER OF WIRED ALARM SYSTEM COMPONENTS

CROSS-REFERENCE TO RELATED APPLICATIONS

Not Applicable.

BACKGROUND

Background and Relevant Art

Many homeowners and businesses use an alarm system to protect their real and personal property. An alarm system can be used to detect physical disturbances on a premise and alert an owner and/or authorities about the physical disturbance. An alarm system can be a stand alone system or integrated within a larger security system context (e.g., that also includes armed guards, CCTV, etc.)

A typical alarm system includes a number of sensors linked to a control panel. The control panel includes an interface that can be used by a human user to arm, or in many cases activate monitoring (e.g., when leaving their residence) and disarm, or in many cases deactivate (e.g., when re-entering their residence) monitoring of the sensors. A control panel can also include other functions, such as, for example, a physical duress alarm, two-way voice communication, a siren, etc. Different types of sensors are configured to monitor for different physical disturbances. For example, a door/window sensor is configured to detect when a door/window has been opened, a motion detector is configured to detect motion, a glass break detector can be configured to detect the physical event of glass being broken or even to detect the sound of breaking glass.

Monitoring can include a control panel locally monitoring sensor activity on a premise as well as a central monitoring system remotely monitoring the alarm system. To facilitate remote monitoring an alarm system communicates signals (alarm events and/or non alarm events) to the central monitoring station via a phone line, cellular transmission, over the Internet, etc. Thus, the control panel is typically monitored in some way. For residential alarm systems, a remote central monitoring station can be a third party vendor or in some cases the same company that installed the alarm system. For commercial and industrial alarm systems, monitoring is sometimes performed on the premises, for example, by security or other personnel. In these types of commercial and industrial settings the control panel can be integrated into a larger security system context.

In any event, when sensor monitoring is activated and a sensor indicates a physical disturbance, the control panel can activate an alarm. In response to an alarm, the control panel can activate an audible siren and/or send an indication of the alarm to a central monitoring entity via an alarm event signal. The monitoring entity can then initiate a response, such as, for example, contacting the premise owner, sending security personnel, contact authorities, etc.

Most alarm systems include a mix of passive and active sensors. A passive sensor monitors for naturally occurring changes in it surrounding environment. Passive sensors include door/window sensors, glass break sensors, and some types of motion sensors. For example, a door sensor monitor can indicate a transition from a close to an open circuit when a monitoring door is open. A Passive Infrared (PIR) motion passive accepts incoming infrared radiation but does not emit an infrared beam. A PIR motion detector detects differences in emitted infrared energy between different objects, such as, for example, when a human is present in front of a wall.

Active sensors include some types of motion sensors. Active sensors detect energy input from a source other than that which is being sensed. In many alarm systems, an active sensor provides its own energy for illumination of an object. That is, an active sensor emits energy (e.g., IR, visible light, etc.) into its surrounding environment and measure how the surrounding environment interacts with the energy. However, emission and detection of energy can be performed by different devices. An active sensor can measure an angle of reflection of emitted energy, how long energy took to return to the sensor, etc., for example, to detect motion. Since emitting energy into a surrounding area consumes power, additional wiring is typical required connecting active sensors to a wired power source.

In some alarm systems, even those that use only passive sensors, some or all sensors communicate with a control panel via hardwired links. When a sensor detects a physical disturbance, an indication of the disturbance is communicated to the control panel over a hardwired link. For door/window sensors, the indication can be transition from a closed to an open circuit (e.g., a door sensor detecting that a door is open). For motion sensors, the indication can be a signal of an irregular energy pattern in the surrounding area.

In other alarm systems, some or all sensors communication with a control panel via wireless links. For wireless communication, each wireless sensor includes a wireless transmitter that transmits data on a specified radio frequency. The control panel includes wireless receiver that is tuned to receive data on the specified frequency. Most wireless sensors and wireless control panels are digital and send/receive digital data, preventing the use of wired sensors. However, some wireless control panels do provide limited capability to connect passive wired sensors (e.g., providing one or two connections for passive wired sensors).

When considering how to supplement an alarm system with new sensors one option is to install additional wired sensors. However, installing new wired sensors requires running additional wires, which can be time consuming and costly.

On the other hand, there a number of benefits to using wireless technologies to supplement existing alarm systems. One advantage is eliminating the time and cost associated with running wire within an existing structure. Further, adding a wireless sensor to an alarm system that already includes a wireless control panel is relatively simple. A new wireless sensor is placed and the control panel is programmed to monitor the new wireless sensor.

Unfortunately, it can be problematic to supplement an existing hardwired alarm system (e.g. that already includes a number of wired sensors) with additional wireless sensors. Some existing wired control panels are not compatible with wireless sensors and wireless sensor protocols. Thus, using even one wireless sensor with an existing wired alarm system can require replacement of an existing wired control panel with a wireless control panel. However, switching to a wireless control panel significantly limits (and depending on the wired control panel potentially eliminates) the use of existing wired sensors. To regain the functionality of the existing wired sensors, corresponding wireless sensors must be purchased and installed.

Thus, when considering how to supplement an existing wired alarm system with addition sensors, a user is often forced to make a difficult choice. On one hand, the user can chose to install additional wired sensors. However, choosing to use additional wired sensors results in the time and cost burdens associated with running additional wiring. On the other hand, the user can chose to install new wireless sensors. However, choosing to use wireless sensors typically requires replacement of an existing wired control panel with a wireless control panel. Replacement of the existing wired control panel can result in loss of functionality for many wired sensors (due either to sensor type or number of sensors). To regain the lost functionality, the user is typically required to purchase corresponding wireless sensor replacements.

BRIEF SUMMARY

The present invention extends to methods, circuits, and systems for wireless takeover of wired alarm system components. Embodiments of the invention include an alarm system comprising wired alarm hardware, such as, for example, a wired alarm controller. The wired alarm hardware is configured to receive wired sensor input from a plurality of connected wired alarm sensors. One or more wires connect each wired sensor to the wired alarm hardware.

The alarm system also includes a takeover module. The takeover module includes external connections, a microprocessor, and a wireless transmitter. The external connections are configured to connect to the one or more wires connected to each wired alarm sensor. Accordingly, wired sensor input from the wired alarm sensors (including alarm conditions) is received at the external connections. The microprocessor is configured to receive wired sensor input from the wired alarm sensors over the external connections. The microprocessor is also configured to convert the wired sensor input (including alarm conditions) into wireless sensor input data (e.g., representing alarm conditions). The wireless sensor input data is converted to a format that is compatible with an alarm controller that accepts wireless sensor signals.

The wireless transmitter is configured to transmit the wireless sensor input data (e.g., representing alarm conditions) to the wireless alarm controller using a compatible frequency and wireless sensor protocol. Thus, the takeover module bridges the wired alarm sensors for monitoring by the wireless alarm controller. As a result, the wireless transmitter can make it appear to a wireless alarm controller that the wireless alarm controller is receiving wireless sensor input data from one or more wireless alarm sensors.

In some embodiments, a takeover module is connected to and powered from an electrical terminal at the wired alarm hardware. An AC power source connected to the wired alarm hardware provides power to the electrical terminal. The takeover module is also connected to the backup battery for the wired alarm hardware. The takeover module includes a battery monitoring module. The battery monitoring module is configured to test the sufficiency of the battery backup to power the takeover module when a loss of power is detected on the wired power output terminal (e.g., when AC power to the wired alarm hardware is lost). When an insufficient battery is detected, the battery monitoring module can send a low battery indicator to the microprocessor. The microprocessor can convert the low battery indicator into wireless sensor input data indicative of a low battery. The transmitter can transmit the wireless sensor input data indicative of a low battery to a wireless alarm controller.

Other embodiments include a method for taking over wired alarm system components for use in a wireless alarm system. Wired sensor input (e.g., including alarm conditions) is received from a plurality of different defined alarm zones of a wired alarm system. The received wired sensor input is received over one or more wires connected to wired sensors in each of the plurality of different defined alarm zones. The wired sensor input is conditioned for processing by a processor. A processor receives the conditioned wired sensor input for each of the plurality of different defined alarm zones. The processor converts the wired sensor input into a wireless input data stream. The wireless input data stream is in a format that is compatible with a wireless alarm controller.

The processor sends the wireless input data stream to a wireless transmitter. The wireless transmitter receives the input data stream from the processor. The wireless transmitter transmits the wireless sensor input data to a wireless alarm controller using a compatible wireless sensor protocol. Transmission of the wireless input data stream is used to simulate transmission of input data from a wireless sensor to the wireless alarm controller. Accordingly, it appears as if a wireless sensor is sending the wireless sensor input data.

This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Additional features and advantages of the invention will be set forth in the description which follows, and in part will be obvious from the description, or may be learned by the practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION

Figure 1:
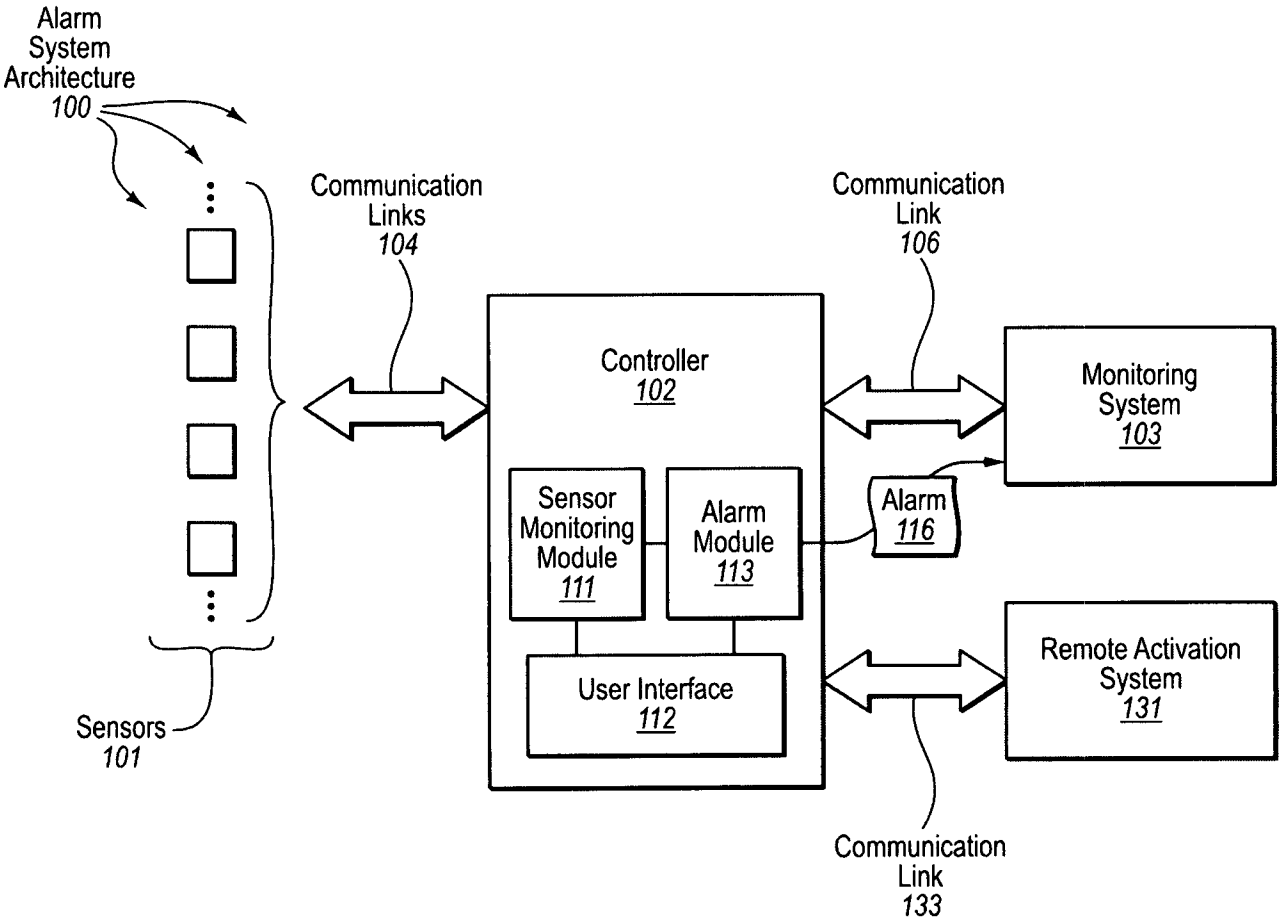
FIG. 1 illustrates an example alarm system architecture.

The present invention extends to methods, circuits, and systems for wireless takeover of wired alarm system components. Embodiments of the invention include an alarm system comprising wired alarm hardware, such as, for example, a wired alarm controller. The wired alarm hardware is configured to receive wired sensor input from a plurality of connected wired alarm sensors. One or more wires connect each wired sensor to the wired alarm hardware.

The alarm system also includes a takeover module. The takeover module includes external connections, a microprocessor, and a wireless transmitter. The external connections are configured to connect to the one or more wires connected to each wired alarm sensor. Accordingly, wired sensor input from the wired alarm sensors (including alarm conditions) is received at the external connections. The microprocessor is configured to receive wired sensor input from the wired alarm sensors over the external connections. The microprocessor is also configured to convert the wired sensor input (including alarm conditions) into wireless sensor input data (e.g., representing alarm conditions). The wireless sensor input data is converted to a format that is compatible with an alarm controller that accepts wireless sensor signals.

The wireless transmitter is configured to transmit the wireless sensor input data (e.g., representing alarm conditions) to the wireless alarm controller using a compatible frequency and wireless sensor protocol. Thus, the takeover module bridges the wired alarm sensors for monitoring by the wireless alarm controller. As a result, the wireless transmitter can make it appear to a wireless alarm controller that the wireless alarm controller is receiving wireless sensor input data from one or more wireless alarm sensors.

In some embodiments, a takeover module is connected to and powered from an electrical terminal at the wired alarm hardware. An AC power source connected to the wired alarm hardware provides power to the electrical terminal. The takeover module is also connected to the backup battery for the wired alarm hardware. Alternately, a the takeover module can be powered by its own AC power supply source with backup battery capability (e.g., in the absence of wired alarm hardware).

The takeover module includes a battery monitoring module. The battery monitoring module is configured to test the sufficiency of the battery backup (e.g., of the wired alarm hardware) to power the takeover module when a loss of power is detected on the wired power output terminal (e.g., when AC power to the wired alarm hardware is lost). When an insufficient battery is detected, the battery monitoring module can send a low battery indicator to the microprocessor. The microprocessor can convert the low battery indicator into wireless sensor input data indicative of a low battery. The transmitter can transmit the wireless sensor input data indicative of a low battery to an alarm controller that accepts wireless sensor signals.

Other embodiments include a method for taking over wired alarm system components for use in a wireless alarm system. Wired sensor input (e.g., including alarm conditions) is received from a plurality of different defined alarm zones of a wired alarm system. The received wired sensor input is received over one or more wires connected to wired sensors in each of the plurality of different defined alarm zones. The wired sensor input is conditioned for processing by a processor. A processor receives the conditioned wired sensor input for each of the plurality of different defined alarm zones. The processor converts the wired sensor input into a wireless input data stream. The wireless input data stream is in a format that is compatible with an alarm controller that accepts wireless sensor signals.

The processor sends the wireless input data stream to a wireless transmitter. The wireless transmitter receives the input data stream from the processor. The wireless transmitter transmits the wireless sensor input data to a wireless alarm controller using a compatible wireless sensor protocol. Transmission of the wireless input data stream is used to simulate transmission of input data from a wireless sensor to the alarm controller. Accordingly, it appears as if a wireless sensor is sending the wireless sensor input data.

FIG. 1 illustrates an example alarm system architecture 100. As depicted, alarm system architecture 100 includes sensors 101, controller 102, monitoring system 103, and remote activation system 131. Communication links 104 (e.g., a combination of wired and wireless communication links) connects sensors 101 to controller 102. Wired communication links can include circuit loops that are either detected as closed or open. In some embodiments, sensors 101 and controller 102 are located on the same premises, such as, for example, in the same residence or in the same building. Communication link 106 (e.g., a wired telephone connection, wired or wireless network connection, cellular connection, etc. or combination thereof) connects controller 102 to monitoring system 103.

Generally, sensors 101 include any of a variety of different types of sensors, such as, for example, door and window sensors (e.g., normally closed sensors), motion sensor (e.g., passive infrared (PIR)) sensors, glass break sensor (e.g., detecting a physical break or detecting the sound of a glass break), etc. Generally, controller 102 is configured to monitor sensors 101 for alarm conditions via communication links 104 and relay alarms to monitoring system 103 via communication link 106.

Controller 102 includes sensor monitoring module 111, user interface 112, and alarm module 113. Sensor monitoring module 111 is configured to monitor sensors 101. Sensors 101 can sense and/or indicate a change in their physical surroundings (e.g., a normally closed connection becomes open, a signal indicating that the sound of breaking glass was detected, etc), which may be indicative of an unauthorized access, on communication links 104. For example, the circuit connected to a door sensor can transition from closed to open (or at least to a resistance exceeding a pre-determined resistance threshold) indicating that a door has been opened. A motion sensor can send an electrical signal indicative of detected motion. Sensor monitoring module 111 monitors communication links 104 for indications and signals sent from sensors 101. When sensor monitoring module 111 receives an indication or signal of a change in physical surroundings, sensor monitoring module 111 can send the indication or signal to alarm module 113. When appropriate, alarm module 113 can treat a monitored indication or signal from a sensor as an alarm condition.

User interface 112 can include an input interface and an output interface. The input interface can a physical input interface or virtual input interface that includes one or more a numeric key pad (e.g., for entering a disarm code), sensor activation buttons, physical duress buttons, etc. The input interface can also include a condenser for receiving audio input and/or communicating with monitoring system 103. The output interface includes an output display device that display system status, such as, for example, armed, disarmed, sensors/zones that have detected change in physical surroundings, etc. The output interface can also include a speaker that audible outputs information similar to that displayed on the output display device. The speaker can also be used by monitoring system 103 to communicate with a user of controller 102.

Accordingly, user interface 112 can be used to arm or disarm alarm system architecture 100. When disarmed, alarm module 113 does not treat many monitored indications or signals from sensors as alarm conditions. For example, when disarmed, alarm module 113 does not consider detecting a door opening or detecting motion as an alarm condition.

However, alarm module 113 can provide a status message, for example, an audible beep or a message indicating that a door has been opened.

On the other hand, when armed, alarm module 113 can consider indications and signals from sensors as an alarm condition. However, upon receiving a detected indication or signal from a sensor, alarm module 113 can delay some amount of time before registering an alarm condition as an alarm. For example, upon detecting that a door has been opened, their may be some delay to permit entering of a disarm code.

Alarm system architecture 100 can also include continuous (or "24-hour") monitoring zones, such as, for example, a gun cabinet or smoke detector. Continuous monitoring zones continue to be monitored and can signal alarm conditions even when the alarm system is disarmed.

When an alarm is registered, an audible indicator of the alarm can be output at the speaker. Additionally, an alarm message, such as, for example, alarm 116 can be sent to monitoring system 103. An operator at monitoring system 103 can review alarm message 116 and respond as appropriate. If equipment permits, an operator at monitoring system 103 may also speak to an end user through "two-way voice" functionality directly through the speaker when alarm signals are received at monitoring system 103. The operator can also attempt to contact the owners or other authorized contacts of the monitoring premises, alert fire, medical, or law enforcement personnel, dispatch a private security guard to investigate, etc.

Communication link 133 connects controller 102 and remote activation system 131. For example, communication link 133 can be a network link between controller 102 and remote activation system 131. An authorized user can access remote activation system 131 and interact remotely (e.g., through a Web based interface) with controller 102 remotely. Through remote interaction, many of the functions performable through user interface 112 (e.g., arming and disarming) can also be performed remotely.

Figure 2A:
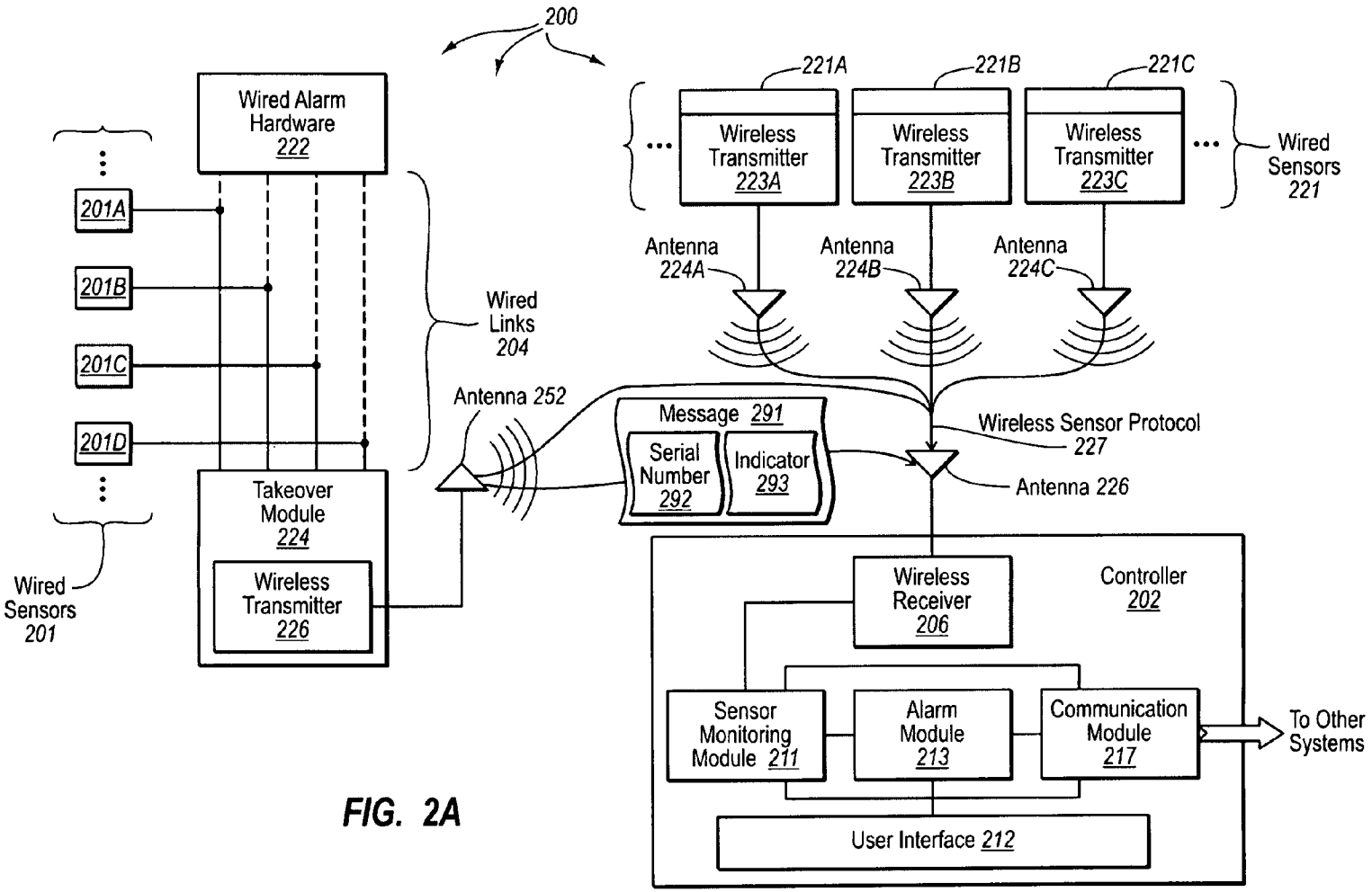
FIG. 2A illustrates an example alarm system architecture that facilitates wireless takeover of wired alarm system components.

FIG. 2A illustrates an example alarm system architecture 200 that facilitates wireless takeover of wired alarm system components. As depicted, alarm system architecture 200 includes wired sensors 201, controller 202, (e.g., a controller panel configured to accept wireless signals), wireless sensors 221, wired alarm hardware 222 (e.g., part of a wired controller), and takeover module 224.

Generally, controller 202 is configured to monitor one or more wireless sensors and can also be configured to monitoring one or more wired sensors. Thus, in some embodiments controller 202 is configured to monitor both wireless and wired sensors.

Controller 202 includes sensor monitoring module 211, alarm module 213, communication module 217, and user interface 213, which in general are configured and can perform similarly to the modules of controller 102. Communication module 217 is configured to communicate with one or more remote systems, such as, for example, a monitoring system and/or a remote activation system. Further, controller 202 is also more specifically configured to monitor wireless sensors and register alarms in response to signals from wireless sensors. Accordingly, controller 202 also includes wireless receiver 206 and antenna 226. Antenna 226 is configured receive wireless communication and forward the wireless communication to wireless receiver 206 for interpretation.

Wireless sensors 221 include a plurality of wireless sensors, including wireless sensors 221A, 221B, and 221C. Each wireless sensor can be any type of sensor as previously described, such as, for example, a window/door sensor, a motion sensor, a glass break sensor, etc. Each wireless sensor 221A, 221B, and 221C also includes a corresponding wireless transmitter (223A, 223B, and 223C respectively) and antenna (224A, 224B, and 224C respectively). Wireless transmitters are configured to construct wireless communication that is then transmitted from a corresponding antenna.

From time to time, or at specified intervals, each wireless sensor can send a status message to controller 202. A status message can indicate if wireless sensor has detected a change in its physical surroundings. Wireless receiver 206 can receive status messages from wireless sensors. To facilitate wireless communication between wireless sensors 221 and controller 202, wireless sensors 221 and controller 202 can be configured to: a) transmit and receive in the same frequency range (or even at the same frequency), b) use the same wireless sensor protocol, and c) use the same data formats.

Accordingly, wireless transmitters 223A, 223B, and 223C (along with wireless transmitters at any other wireless sensors in wireless sensors 221) can be configured to transmit on a frequency (range) and wireless receiver 206 can be configured to receive on the same frequency (range). Further, wireless transmitter 223A, 223B, and 223C (along with wireless transmitters at any other wireless sensors in wireless sensors 221) and wireless receiver 206 can all be configured to use the same wireless sensor protocol, such as, for example, wireless sensor protocol 227. Additionally, wireless transmitter 223A, 223B, and 223C (along with wireless transmitters at any other wireless sensors in wireless sensors 221) and wireless receiver 206 can all be configured to use the same data formats.

Frequencies, wireless sensor protocols, and data formats can be vendor specific. Thus, frequencies, wireless sensor protocols, and data formats can differ between wireless sensors and wireless compatible controllers manufactured by different vendors. For example, one or more of a first vendor's frequencies, wireless sensor protocols, and data formats can differ from one or more of a second vendor's frequencies, wireless sensor protocols, and data format. As a result, wireless sensors and wireless compatible controllers from one vendor may not compatible with wireless sensors and controllers from another vendor.

Wired sensors 201 include a plurality of wired sensors including wired sensors 201A, 201B, 201C, and 201D. Each wired sensor can be any type of sensor as previously described, such as, for example, a window/door sensor, a motion sensor, a glass break sensor, etc. Each wired sensor can include a plurality of wires for connection to a wired monitoring module. Passive sensors can include two wires, for example, for establishing a loop that can be monitored for transitions between opened and closed status. Active sensors can include a third wire for externally provided power.

As depicted in FIG. 2A, wired links 204 (the solid lines) connect sensors 201 to takeover module 224. The dashed lines indicate that wired links were previously connected to wired alarm hardware 222. It may be that wired alarm hardware 222 and wired sensors 201 were include in a wired alarm system that monitored a particular premise. The party responsible for physical security of the premise may determine that supplementing the wired alarm system with additional sensors would increase security. However, running wires for additional wired sensors may be costly and inefficient. Accordingly, the responsible party can choose instead to use takeover model 224. The use of takeover model 224 permits alarm system architecture 200 to be supplemented with wireless sensors 221 and yet still retain the functionality of wired sensors 201.

Generally, takeover module 224 facilitates wireless takeover of wired alarm system components. Takeover model 224 is configured to receive signals and indications from wired sensors 201 and convert the signals and indications into wireless communication that is compatibility receivable at controller 202. When signals and indications are received from wired sensors 201, takeover module 224 can convert the signals and indications into digital data. Wireless transmitter 226 can then interoperate with antenna 252 to transmit the digital data to controller 202. Wireless transmitter 226 can be configured to transmit on a frequency that wireless receiver 206 is configured to receive. Wireless transmitter 226 can also be configured to use wireless sensor protocol 227 and data formats compatible with wireless receiver 206. Accordingly, controller 202 views wireless communication received from takeover module 224 similarly to wireless communication received from a wireless sensor.

Figure 2B:
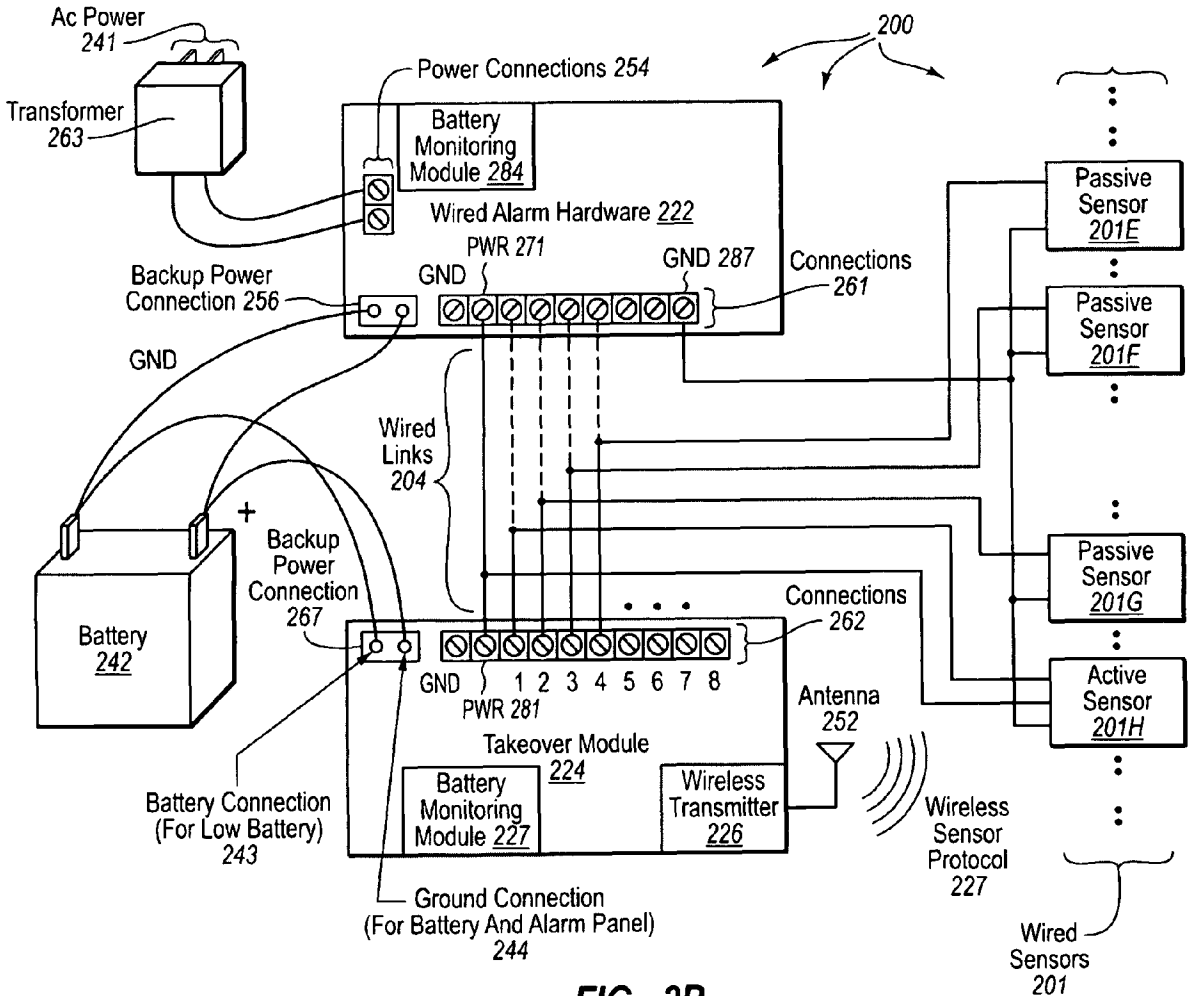
FIG. 2B illustrates a more detailed view of wired alarm hardware and wires sensors and a takeover module that facilitates wireless takeover of wired alarm system components.

FIG. 2B illustrates a more detailed view of wired alarm hardware 222, wired sensors 201 and takeover module 224 that facilitates wireless takeover of wired alarm system components.

As depicted in FIG. 2B, transformer 263 is connected to AC power 241 (e.g., 120V AC). Transformer 263 can transform AC power 241 to a compatible voltage that is compatible with the components of wired alarm hardware 222. Transformer 263 can provide the compatible voltage to wireless alarm hardware 222 at power connection 254. A compatible voltage can be vendor specific. Thus, transformer 263 can be specifically configured for use with wired alarm hardware 222 (and may even be manufactured by same vendor). In some embodiments, a compatible voltage is in a range from 9V to 24V and can be either AC or DC voltage.

Battery 242 is connected to wired alarm hardware 222 at backup power connection 256. Battery 242 is configured to provide power to wired alarm hardware 222 when AC power 241 is off The voltage of battery 242 can be a DC voltage similar or equal to the compatible voltage output from transformer 263. Wired alarm hardware 222 can include appropriate circuitry for operating on power provided by battery 242 (i.e., backup power) when AC power 241 is off When AC power 241 is on, wired alarm hardware 222 can charge battery 242 through backup power connection 256.

Wired alarm hardware 222 can also includes battery monitoring module 284. From time to time, such as, for example, every three or four hours, battery monitoring module 284 can disconnect wired alarm hardware 222 from power connection 254. Thus, other components of wired alarm hardware 222 detect that AC power 241 is off In response, wired alarm hardware 222 transitions to powering its components from the power provided by battery 242 at backup power connection 256. Battery monitoring module 284 then monitors the voltage of battery 242 under the load of powering the components of wired alarm hardware 222. When the voltage of battery 242 is insufficient, wired alarm hardware 222 can activate a low battery signal.

Connections 261 are used to connect wired alarm hardware 222 to wired sensors. For example, connections 261 can be connected to passive sensors 201E, 201F, 201G and active sensor 201H. However, when supplementing alarm system architecture 200 with wireless sensors, passive sensors 201E, 201F, 201G and active sensor 201H can instead be rewired to connections 262 on takeover module 224. After rewiring, takeover module 224 monitors for indications and signals output by passive sensors 201E, 201F, 201G and active sensor 201H. The dashed lines indicate how wired sensors 201 were previously connected to connections 261.

As depicted, wired alarm hardware 222 includes auxiliary power connection 271. Auxiliary power connection 271 provides power for powering active sensors. Thus, active sensors, such as, for example, active sensor 201H are connected to auxiliary power connection 271. When AC power 241 is off or when battery monitoring module 284 disconnects wired alarm hardware 222 from power connection 254, power is also lost from auxiliary power connection 271.

Power provided at auxiliary power connection 271 can also be used to power takeover module 224. Thus, auxiliary power connection 271 can be connected to power connection 281 of takeover module 224. Battery 242 is also connected to backup power connection 267 (battery connection 243 and ground connection 244) of takeover module 224 to provide takeover module 224 with backup power. When power is detected at power connection 281 (e.g., when AC power 241 is on and battery monitoring module 284 is not checking battery 242), takeover module 224 is powered from power provided at connection 281. On the other hand, when power is not detected at power connection 281, takeover module 224 is powered from power provided at backup power connection 267.

Takeover module 224 also includes battery monitoring module 227. When power is not detected at power connection 281, battery monitoring module 227 can monitor the voltage of battery 242 under the load of powering the components of takeover module 224. When the voltage of battery 242 is insufficient, takeover module 224 can activate a low battery signal.

As previously described, battery monitoring module 284 can intermittently disconnect wired alarm hardware 222 from power connection 254 to check battery 242 under load. When power connection 254 is disconnected, power at auxiliary power connection 271 and thus also at power connection 281 is lost. Power loss at power connection 281 causes battery monitoring module 227 to check battery 242 under load. Thus, battery monitoring module 284 can trigger battery monitoring module 227 to check the sufficiency of battery 242 by disconnecting power at power connection 254. Accordingly, monitoring logic of battery monitoring module 284 is essentially mimicked at battery monitoring module 227.

As depicted, the ground connections for wired sensors 201 remain connected to ground terminal 287. Connection to ground terminal 287 provides wired sensors 201 with a common ground through wired alarm hardware. Thus, there is little, if any, need to move ground wires for wired sensors 201 from wired alarm hardware 222 to takeover module 224. Accordingly, the number of wires reconnected to facilitate wireless takeover of wired sensors 101 is reduced.

Figure 2C:
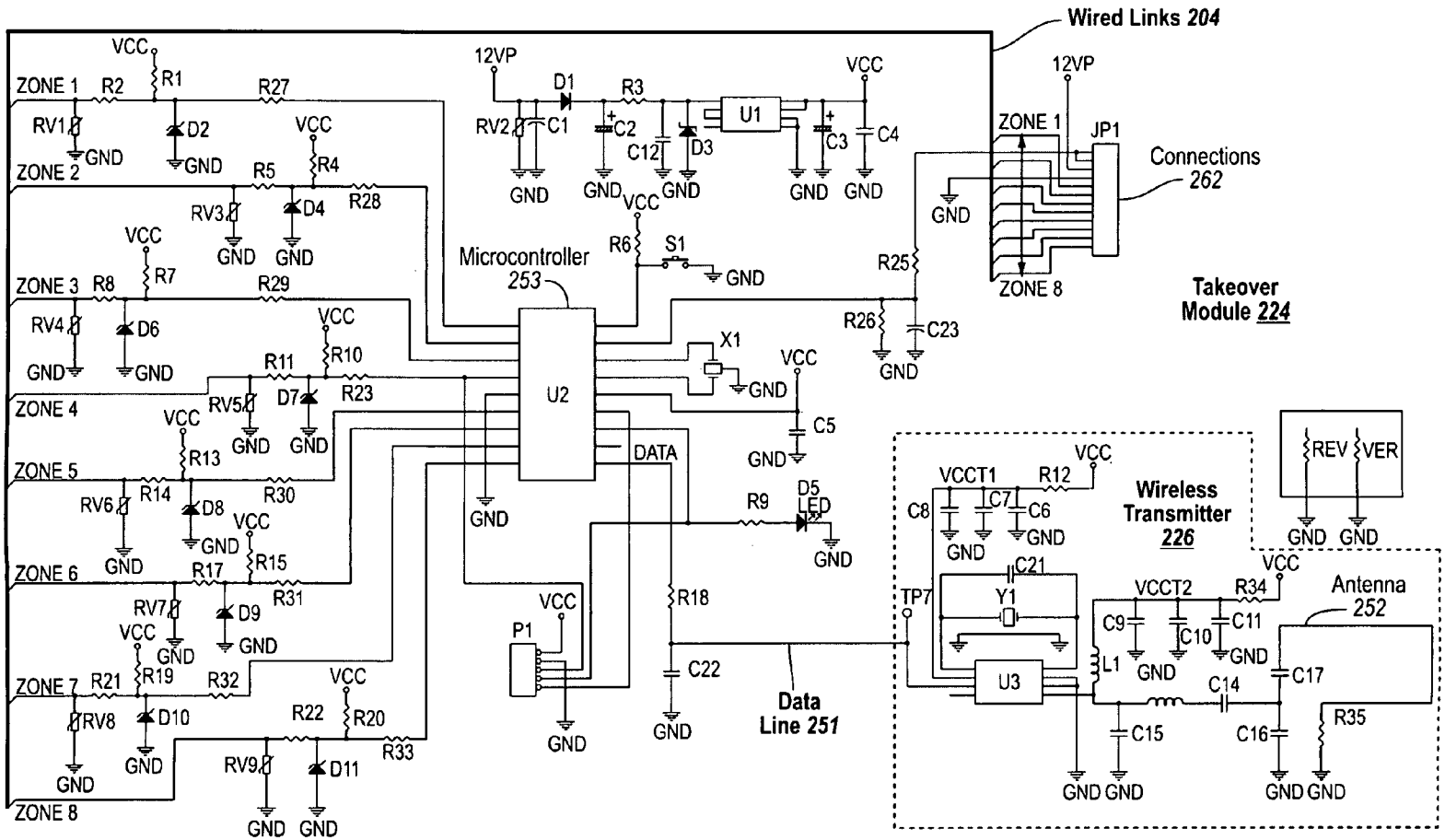
FIG. 2C illustrates a more detailed view of a takeover module that facilitates wireless takeover of wired alarm system components.

FIG. 2C illustrates a more detailed view of takeover module 224 that facilitates wireless takeover of wired alarm system components. Wired sensors connected to takeover module 224 can be divided between a plurality of different zones. For example, wired links 204 can be divided into zones 1 through 8. Circuitry inline with the wired connection for each zone can be used to condition indications and/or signals received on the wired connection for processing by microcontroller 253. Microcontroller 253 is configured to process conditioned indications and/or signals and convert the conditioned indications and/or signals into digital data. Microcontroller 253 can output digital data to wireless transmitter 226 on data line 251.

When converting data, microcontroller 253 can use unique serial numbers to identify each zone. In some embodiments, the serial numbers are assigned in consecutive order such that zone 1 has serial number 1, zone 2 has serial number 2, etc.

Microcontroller 253 can also format an indication and/or signal from a wired sensor into data format that is compatible with the modules of controller 202. Microcontroller 253 can map a serial number with indications and/or signals received from corresponding zones so that controller 202 is given an indication where possible alarm conditions occur. For example, returning briefly to FIG. 2A, takeover module 224 can transmit message 291 to controller 202. Message 291 maps serial number 291 (e.g., the serial number for zone 1) to indication 293 (e.g., a door open indication from passive sensor 201E). From the information in message 291, controller 202 can determine whether or not to register an alarm (e.g., a door open alarm) for the specified zone (e.g., wired zone 1).

Microcontroller 253 can also create digital data related to events originating at takeover module 224. For example, microcontroller 253 can receive a low battery indication from battery monitoring module 227 and convert the low battery indication to corresponding digital data. Wireless transmitter 226 can then transmit the corresponding digital data to controller 202 to alert controller 202 about the low battery.

Takeover module 224 is depicted for use with eight different hardwired zones. However, other takeover modules can be configured for use with a fewer number of different zones (e.g., 3, 4, or 6) or a greater number of different zones (e.g., 10, 12, 14, 16, etc.). Further, in some embodiments, a plurality of takeover modules is utilized within an alarm system architecture to takeover a larger number of wired sensors. Takeover modules can be configured to prevent zone overlap. For example, a first takeover module can be configured to monitor wired zones 1-8, a second takeover module can be configured to monitor wired zones 9-16, etc.

Figure 3:
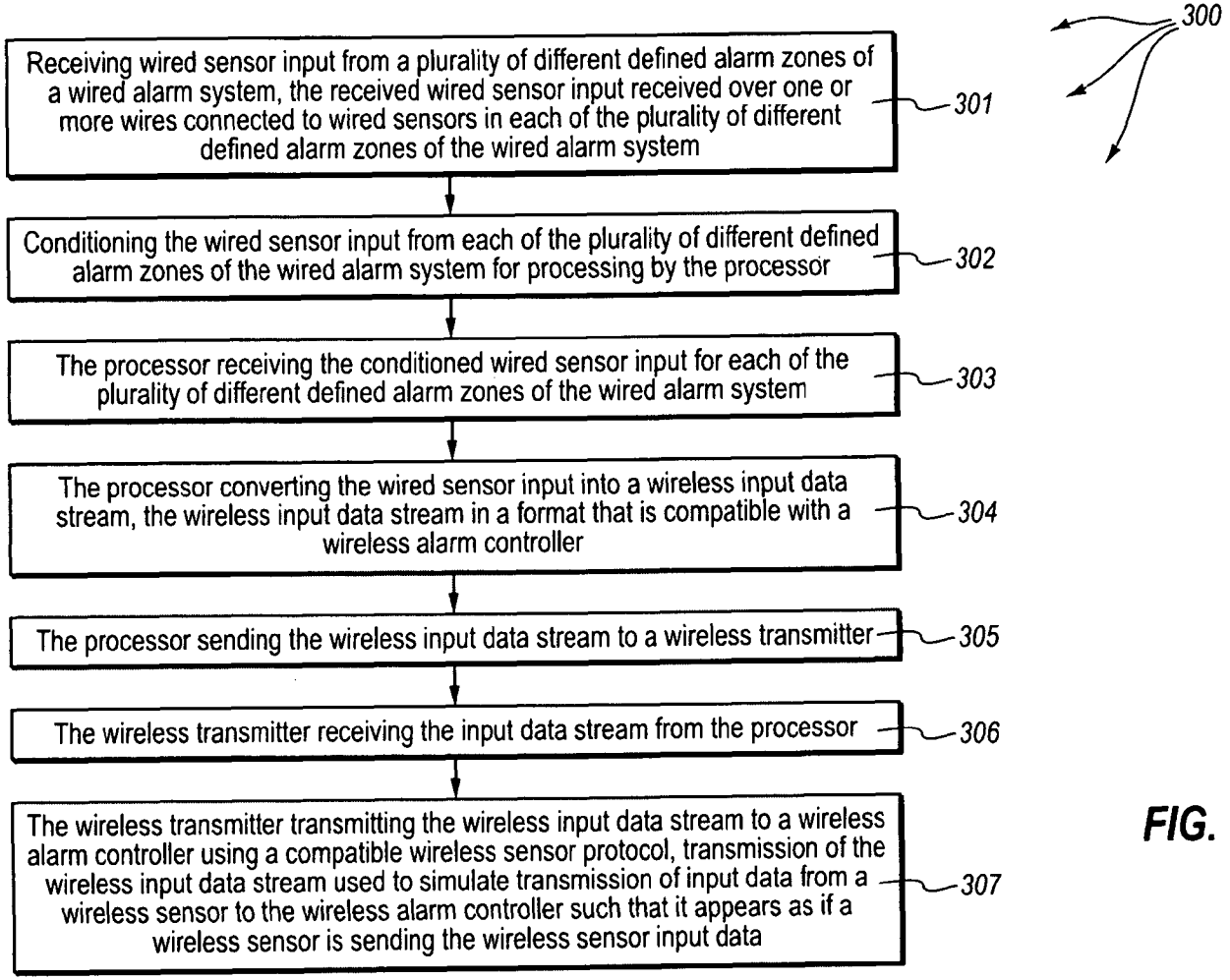
FIG. 3 illustrates a method for wirelessly taking over wired alarm system components.

FIG. 3 illustrates a method 300 for wirelessly taking over wired alarm system components. Method 300 will be described with respect to the components and data of alarm system architecture 200.

Method 300 includes receiving wired sensor input from a plurality of different defined alarm zones of a wired alarm system, the received wired sensor input received over one or more wires connected to wired sensors in each of the plurality of different defined alarm zones of the wired alarm system (act 301). For example, takeover module 224 can receive input from wired sensors 101 over wired links 204. Wired sensors 201 can be divided across wired alarm zones 1-8 of takeover module 224.

Method 300 includes conditioning the wired sensor input from each of the plurality of different defined alarm zones of the wired alarm system for processing by the processor (act 302). For example, circuitry inline with wired links 204 can condition the wired sensor input from wired sensors 201 for processing by microcontroller 253. Method 300 includes the processor receiving the conditioned wired sensor input for each of the plurality of different defined alarm zones of the wired alarm system (act 303). For example, microprocessor 253 can receive the conditioned wired sensor input for wired sensors 101.

Method 300 includes the processor converting the wired sensor input into a wireless input data stream, the wireless input data stream in a format that is compatible with a wireless alarm controller (act 304). For example, microcontroller 253 can convert wired sensor input from wired sensors in to digital data for transfer on data line 251. The digital data can be in a format compatible with controller 202. Method 300 includes the processor sending the wireless input data stream to a wireless transmitter (act 305). For example, microcontroller 253 can send digital data representing wired sensor input to wireless transmitter 226 via data line 251.

Method 300 includes an act of the wireless transmitter receiving the input data stream from the processor (act 306). For example, wireless transmitter 226 can receive digital data representing wired sensor input form microcontroller 253 via data line 251. Method 300 includes the wireless transmitter transmitting the wireless input data stream to a wireless alarm controller using a compatible wireless sensor protocol, transmission of the wireless input data stream used to simulate transmission of input data from a wireless sensor to the wireless alarm controller such that it appears as if a compatible wireless sensor is sending the wireless sensor input data (act 307). For example, wireless transmitter 226 can transmit the digital data (e.g., message 291), representing wired sensor input, to controller 202 using wireless sensor protocol 227. Transmission of the digital data simulates transmission of data from a compatible wireless sensor. Thus, it appears to controller 202 as if a compatible wireless sensor (e.g., similar to 221A, 221B, 221C, etc.) is sending data to controller 202.

Accordingly, embodiments of the invention can be used to bridge hardwired alarm zones for use with a wireless alarm controller. Wired sensors are wired to a takeover module that converts communication from the wired sensors into a format that can be compatibly processed at the wireless alarm controller. Power and ground connections from an existing wired alarm controller can be used with the takeover module.

Additionally, embodiments of the present invention may comprise or utilize a special purpose or general-purpose computer including computer hardware, as discussed in greater detail below. Embodiments within the scope of the present invention also include physical and other computer-readable media for carrying or storing computer-executable instructions and/or data structures. Such computer-readable media can be any available media that can be accessed by a general purpose or special purpose computer system. Computer-readable media that store computer-executable instructions are physical storage media. Computer-readable media that carry computer-executable instructions are transmission media. Thus, by way of example, and not limitation, embodiments of the invention can comprise at least two distinctly different kinds of computer-readable media: computer storage media and transmission media.

Computer storage media includes RAM, ROM, EEPROM, CD-ROM or other optical disk storage, magnetic disk storage or other magnetic storage devices, or any other medium which can be used to store desired program code means in the form of computer-executable instructions or data structures and which can be accessed by a general purpose or special purpose computer.

A "network" is defined as one or more data links that enable the transport of electronic data between computer systems and/or modules and/or other electronic devices. When information is transferred or provided over a network or another communications connection (either hardwired, wireless, or a combination of hardwired or wireless) to a computer, the computer properly views the connection as a transmission medium. Transmissions media can include a network and/or data links which can be used to carry or desired program code means in the form of computer-executable instructions or data structures and which can be accessed by a general purpose or special purpose computer. Combinations of the above should also be included within the scope of computer-readable media.

Further, upon reaching various computer system components, program code means in the form of computer-executable instructions or data structures can be transferred automatically from transmission media to computer storage media (or vice versa). For example, computer-executable instructions or data structures received over a network or data link can be buffered in RAM within a network interface module (e.g., a "NIC"), and then eventually transferred to computer system RAM and/or to less volatile computer storage media at a computer system. Thus, it should be understood that computer storage media can be included in computer system components that also (or even primarily) utilize transmission media.

Computer-executable instructions comprise, for example, instructions and data which cause a general purpose computer, special purpose computer, or special purpose processing device to perform a certain function or group of functions. The computer executable instructions may be, for example, binaries, intermediate format instructions such as assembly language, or even source code. Although the subject matter has been described in language specific to structural features and/or methodological acts, it is to be understood that the subject matter defined in the appended claims is not necessarily limited to the described features or acts described above. Rather, the described features and acts are disclosed as example forms of implementing the claims.

Those skilled in the art will appreciate that the invention may be practiced in network computing environments with many types of computer system configurations, including, personal computers, desktop computers, laptop computers, message processors, hand-held devices, multi-processor systems, microprocessor-based or programmable consumer electronics, network PCs, minicomputers, mainframe computers, mobile telephones, PDAs, pagers, routers, switches, and the like. The invention may also be practiced in distributed system environments where local and remote computer systems, which are linked (either by hardwired data links, wireless data links, or by a combination of hardwired and wireless data links) through a network, both perform tasks. In a distributed system environment, program modules may be located in both local and remote memory storage devices.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed:

1. An alarm system, the alarm system comprising:

a plurality of alarm sensors at a monitored location, each alarm sensor of the plurality of alarm sensors including one or more wires for connecting the alarm sensor to alarm hardware; and a takeover module for use at the monitored location, the takeover module including external connections, a microprocessor, and a wireless transmitter, wherein:

the external connections are configured to connect to the one or more wires connected to each alarm sensor independently of the alarm hardware such that sensor input from the alarm sensors is received at the external connections;

the microprocessor is configured to:

receive sensor input from the alarm sensors over the external connections;

convert the sensor input into digital sensor input data in a format that is compatible with an alarm controller at the monitored location that accepts wireless signals originating from the monitored location; and the wireless transmitter is configured to transmit the digital sensor input data locally to the alarm controller using a compatible frequency and wireless sensor protocol.

2. The alarm system as recited in claim 1, further comprising:

an AC power source connected to the alarm hardware, the AC power source providing power to the alarm hardware, including providing power to any active alarm sensors in the plurality of alarm sensors, when the AC power source is on; and a backup battery connected to a positive terminal and a group terminal of the alarm hardware, the backup battery configured to provide power to the alarm hardware, including providing power to the active alarm sensors, when the AC power source is off; and wherein the AC power source charges the backup battery when the AC power source is on.

3. The alarm system as recited in claim 2, wherein the alarm hardware includes a power output terminal that provides power to the wired alarm sensors.

4. The alarm system as recited in claim 3, wherein the external connections of the takeover module are further configured to connect to the power output terminal included in the alarm hardware.

5. The alarm system as recited in claim 4, wherein the alarm hardware is configured to shut off AC power at designated intervals and test a sufficiency of the battery backup to power components connected to the alarm hardware.

6. The alarm system as recited in claim 5, wherein the backup battery is connected to a positive terminal and a ground terminal of the takeover module, the backup battery configured to provide power to components of the takeover module when a loss of power is detected on the power output terminal of the alarm hardware, connection of the battery backup to the ground terminal providing a common ground between the alarm hardware and the takeover module.

7. The alarm system as recited in claim 6, wherein the takeover module includes a battery monitoring module configured to test the sufficiency of the battery backup to power components connected to the takeover module in response to detecting a loss of power on the power output terminal of the alarm hardware.

8. The alarm system as recited in claim 7, wherein the battery monitoring module is further configured to:

detect that the power of the battery backup is approaching a level that would be insufficient to power the components of the takeover module; and send a low battery indicator to the microprocessor in response to the detection; and wherein the microprocessor is configured to:

receive a low battery indicator from the battery monitoring module; and convert the low battery indicator into digital sensor input data indicative of a low battery at a alarm sensor; and wherein the wireless transmitter is configured to:

transmit the digital sensor input data indicative of a low battery to the alarm controller.

9. The alarm system as recited in claim 6, wherein the alarm sensors remain connected to a ground terminal at the alarm hardware to reduce the number of wires that have to be connected to the takeover module, the ground terminal at the alarm hardware connected to the common ground.

10. The alarm system as recited in claim 1, further comprising a wireless alarm controller, the wireless alarm controller configured to receive digital sensor input data from alarm sensors using the compatible frequency and wireless sensor protocol.

11. The alarm system as recited in claim 10, wherein the wireless transmitter transmits digital sensor input data received from the microprocessor to the alarm controller to make it appear to the alarm controller that the alarm controller is receiving digital sensor input data from one or more alarm sensors so as to bridge the alarm sensors for monitoring by the alarm controller.

12. The alarm system as recited in claim 1, wherein the alarm hardware is a wired alarm controller configured to monitor wired alarm sensors.

13. A takeover circuit for taking over alarm system components at a monitored location, the takeover circuit comprising:

a plurality of external connections for connecting to one or more alarm system zones at a monitored location, each alarm system zone including one or more sensors, the external connections configured to connect to the wires for each alarm system zone such that the takeover circuit receives sensor input from each alarm system zone;

electrical components for conditioning sensor input from each alarm system zone for subsequent processing;

a microcontroller configured to receive the conditioned sensor input from each alarm system zone and consolidate the sensor input into a digital input data stream, the digital input data stream in a format that is compatible with an alarm controller at the monitored location that accepts wireless signals originating from the monitored location; and a wireless transmitter configured to transmit the digital input data stream locally to the alarm controller using a compatible wireless sensor protocol, transmission of the digital input data stream used to simulate transmission of input data from a wireless sensor to the alarm controller.

14. The takeover circuit as recited in claim 13, wherein the microcontroller is further configured to:

assign each alarm system zone a serial number representative of a wireless sensor; and associate an assigned serial number for an alarm zone with sensor input received from wired alarm sensors in the alarm zone.

15. The takeover circuit as recited in claim 14, wherein the wireless transmitter is further configured to transmit digital sensor input data associated with an assigned serial number to the alarm controller to make it appear to the alarm controller that the alarm controller is receiving digital sensor input data from wireless alarm sensors so as to bridge input from an alarm system zone for monitoring by the alarm controller.

16. The takeover circuit as recited in claim 15, wherein the microcontroller is further configured to receive sensor input indicating an alarm condition in a corresponding alarm system zone; and wherein the wireless transmitter is configured to transmit an indication of the alarm condition along with the assigned serial number for the alarm system zone to the alarm controller to simulate detection of the alarm condition by a wireless alarm sensor.

17. The takeover circuit as recited in claim 13, further comprising an electrical terminal for connecting to a power output terminal of the wired alarm system controller, the power output terminal powered from an AC power source connected to the wired alarm system controller, the AC power source providing power to the components of the wired alarm system controller.

18. The takeover circuit as recited in claim 17, further comprising a positive electrical terminal and ground electrical terminal for connecting to an external battery backup, the external battery backup providing power to components of the takeover circuit when power is not provided from the power output terminal of the wired alarm system controller.

19. The takeover circuit as recited in claim 18, further comprising a battery monitoring module configured to test a sufficiency of the battery backup to power components connected to the takeover module in response to detecting a loss of power on the power output terminal of the wired alarm system controller, including:

detecting that the power of the battery backup is approaching a level that would be insufficient to power the components of the takeover circuit; and sending a low battery indicator to the microprocessor in response to the detection;

wherein the microcontroller is configured to:

receive a low battery indicator from the battery monitoring module; and convert the low battery indicator into digital sensor input data indicative of a low battery at a wireless alarm sensor; and wherein the wireless transmitter is configured to transmit the digital sensor input data indicative of a low battery to the wired alarm system controller.

20. At a device including a processor, a method for taking over wired alarm system components for use in a alarm system, the method comprising:

receiving sensor input from a plurality of different defined alarm zones of an alarm system at a monitored location, the received sensor input received over one or more wires connected to sensors in each of the plurality of different defined alarm zones of the alarm system;

conditioning the sensor input from each of the plurality of different defined alarm zones of the alarm system for processing by the processor;

converting the sensor input into a digital input data stream in a format that is compatible with an alarm controller at the monitored location and that accepts wireless signals originating from the monitored location;

sending the digital input data stream to a wireless transmitter; and wirelessly transmitting the digital input data stream locally to the alarm controller using a compatible wireless sensor protocol, transmission of the digital input data stream used to simulate transmission of input data from a wireless sensor to the alarm controller such that it appears as if a wireless sensor is sending the digital sensor input data.

21. The method as recited in claim 20, further comprising assigning each defined alarm zone a wireless sensor serial number representative of a wireless sensor prior to receiving sensor input from the plurality of different defined alarm zones of the alarm system.

22. The method as recited in claim 21, wherein receiving sensor input from a plurality of different defined alarm zones of an alarm system comprises receiving sensor input from a wired sensor that is indicative of an alarm condition.

23. The method as recited in claim 22, wherein converting the sensor input into a digital input data stream comprises the converting the sensor input into a digital input data stream that indicates an alarm condition was detected at a wireless sensor, the wireless sensor identified by the serial number assigned to the defined alarm zone that includes the wired sensor.

24. The method as recited in claim 22, wherein wirelessly transmitting the digital input data stream to the alarm controller using a compatible wireless sensor protocol comprises wirelessly transmitting the digital input data stream to the alarm controller to simulate detection of the alarm condition at a wireless sensor connected to the alarm controller.

* * * * *